United States Patent [19]

Feltz

[11] 4,043,844

[45] Aug. 23, 1977

[54] HEAT-TREATED CAST GRINDING MEMBERS

[76] Inventor: Michel J. Feltz, rue Hotteux, 14e, Ayeneux, Belgium

[21] Appl. No.: 688,004

[22] Filed: May 19, 1976

Related U.S. Application Data

[63] Continuation of Ser. No. 406,102, Oct. 12, 1973, abandoned, which is a continuation of Ser. No. 175,200, Aug. 26, 1971, abandoned.

[30] Foreign Application Priority Data

Sept. 1, 1970 Luxembourg ..... 61624
Sept. 1, 1970 Luxembourg ..... 61625

[51] Int. Cl.[2] ..... C22C 38/22

[52] U.S. Cl. ..... 148/37; 148/12.4; 148/125; 148/135

[58] Field of Search ..... 148/31, 35, 38, 37, 148/134, 135, 125, 12.4; 75/126 C, 126 R, 126 A, 123 CB

[56] References Cited

U.S. PATENT DOCUMENTS

| | | | |
|---|---|---|---|
| 1,245,552 | 11/1917 | Becket | 75/126 R |
| 2,201,425 | 5/1940 | Berglund | 45/125 |
| 3,334,996 | 8/1967 | Foster | 75/126 |
| 3,410,682 | 11/1968 | Avery et al. | 148/35 |
| 3,690,957 | 9/1972 | Thompson | 148/35 |

FOREIGN PATENT DOCUMENTS

| | | | |
|---|---|---|---|
| 732,336 | 10/1969 | Belgium | 75/126 R |
| 438,179 | 11/1935 | United Kingdom | 75/126 R |

*Primary Examiner*—Arthur J. Steiner
*Attorney, Agent, or Firm*—Holman & Stern

[57] ABSTRACT

Heat-treated cast grinding members for use in a grinding mills such as grinding balls, lining plates, crushing jaws, etc. are disclosed, which members are subjected to abrasion and repeated impact in the presence of a wet corrosive medium. These members consist essentially of 0.5 to 2.8% carbon, 15 to 35% chromium, and must satisfy the relationship percent Cr — 8 × %C = 11 to 16%. These members are hardened without subsequent tempering from a temperature range of 1075° to 1175° C and evidence a metallographic structure of primary chromium carbides in a ferrite-free matrix which is a predominantly martensitic solid solution consisting essentially of from 0.3% to 0.45% of carbon and from 14% to 18% of chromium. The elements have a Rockwell "C" hardness of at least 60.

20 Claims, 4 Drawing Figures

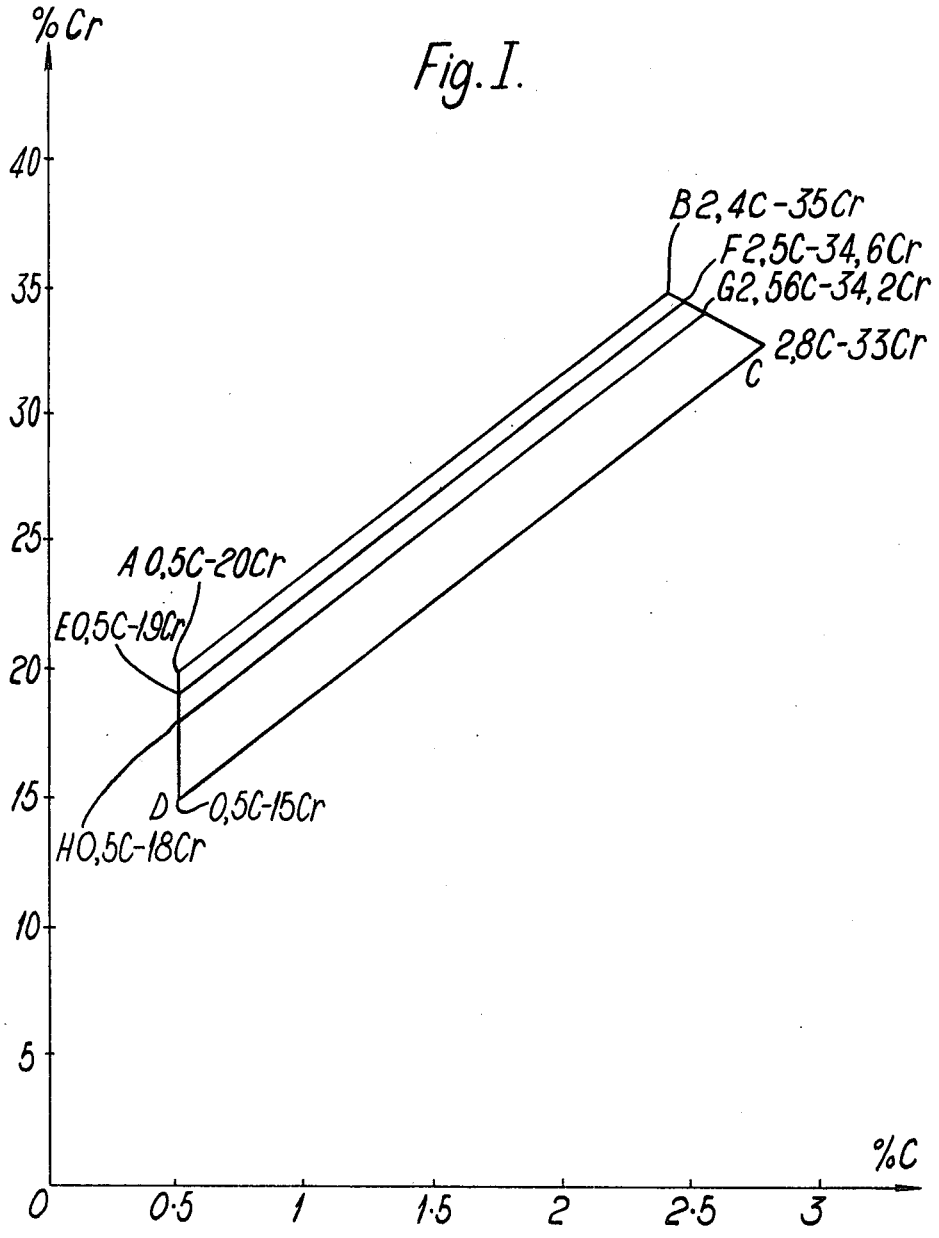
INVENTOR
BY
ATTORNEY

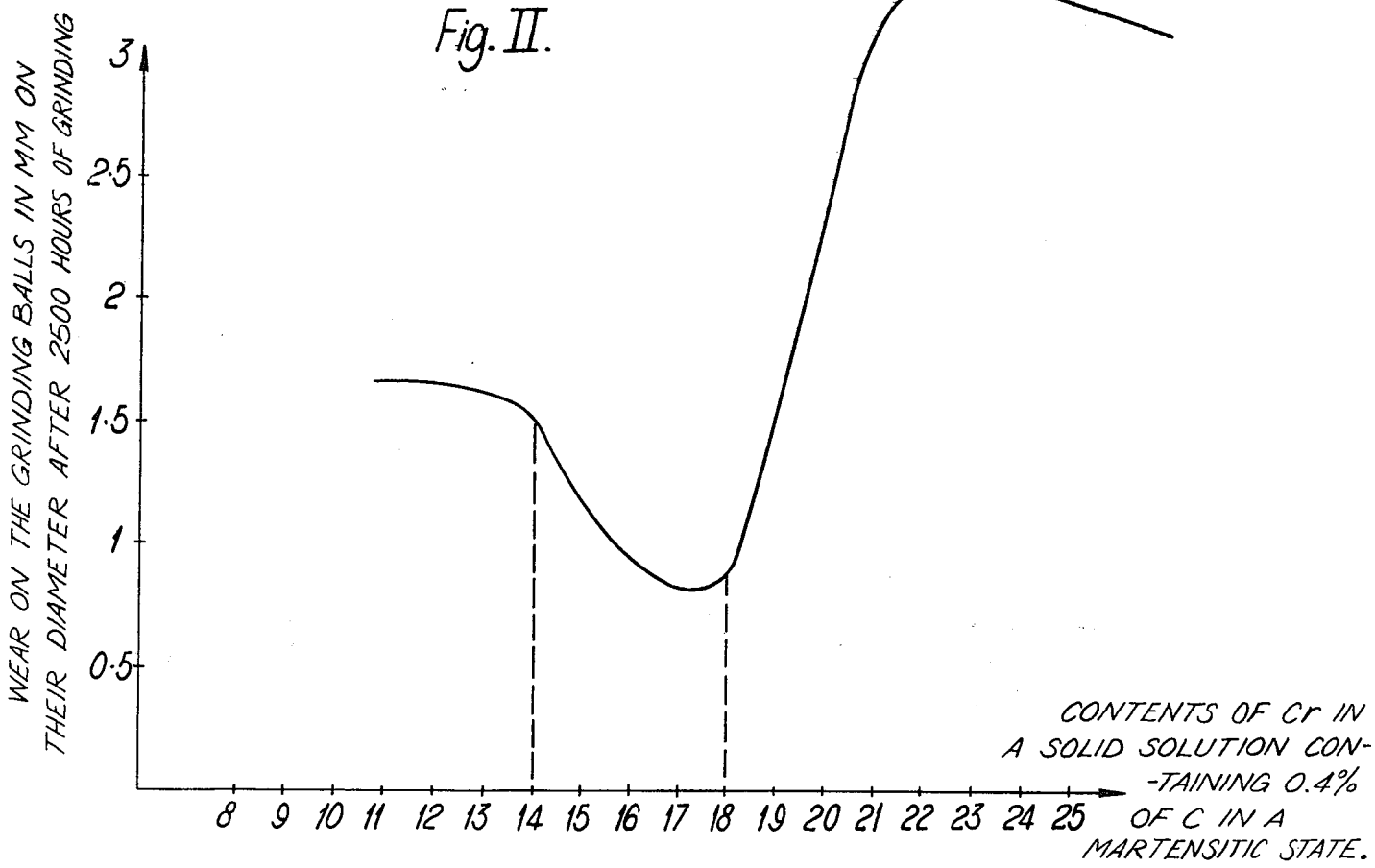
Fig. II.
INVENTOR
BY
ATTORNEY

Fig. III.
SECTION AT 2% C
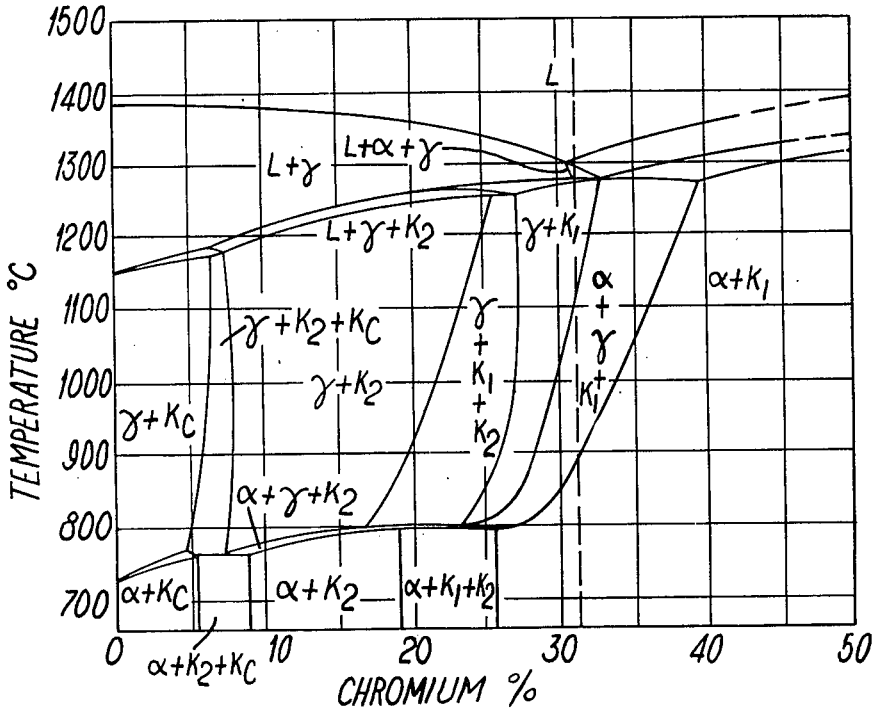
α = ferrite
γ = austenite
Kc = carbide $(Fe,Cr)_3C$
$K_1$ = carbide $(Fe,Cr)_{23}C_6$
$K_2$ = carbide $(Fe,Cr)_7C_3$
INVENTOR
BY
ATTORNEY

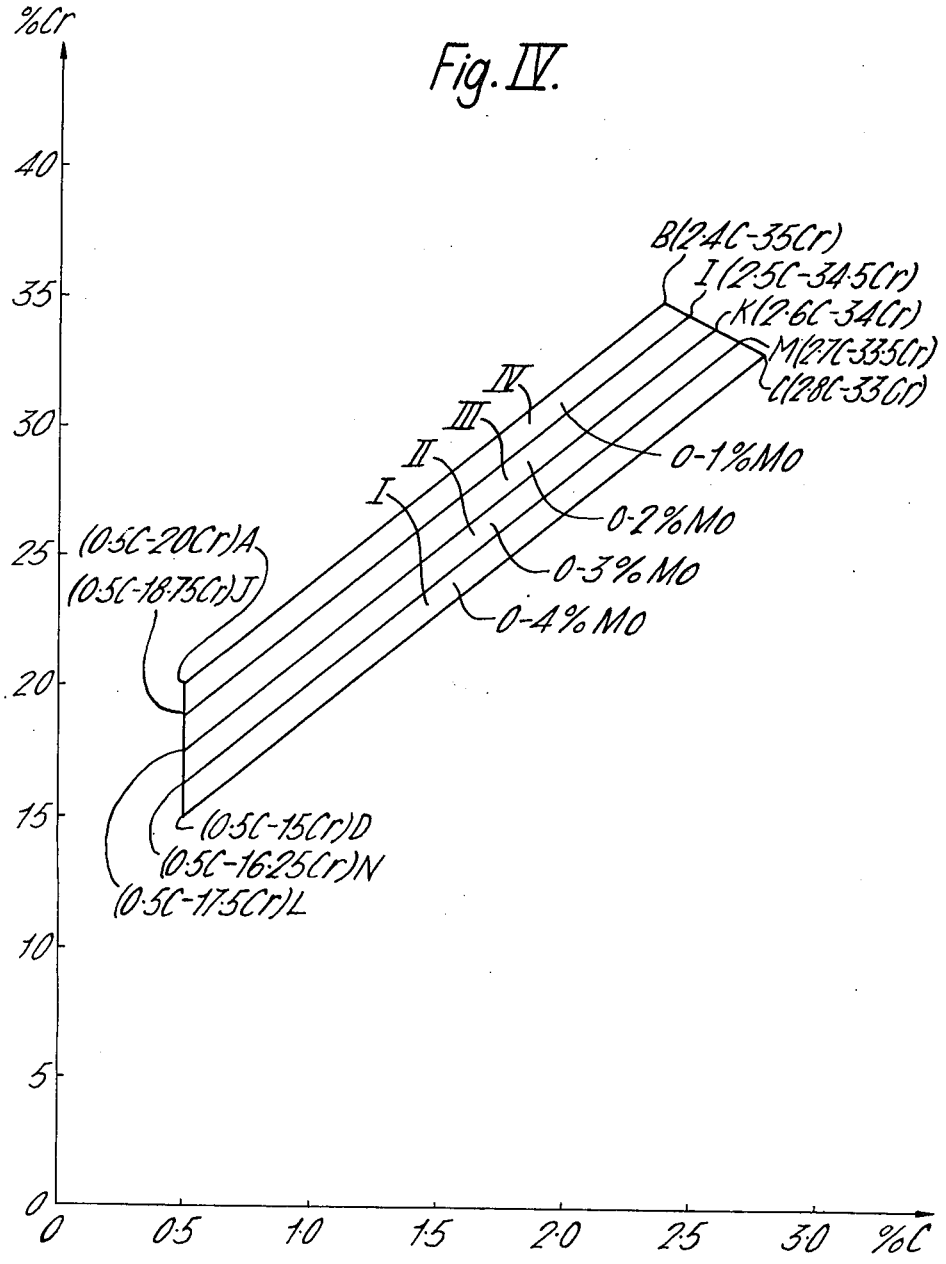
INVENTOR
BY
ATTORNEY

HEAT-TREATED CAST GRINDING MEMBERS

This is a continuation of application Ser. No. 406,102 filed Oct. 12, 1973 which in turn is a Rule 60 Continuation of U.S. Ser. No. 175,200, filed on Aug. 26, 1971, both of which are now abandoned.

BACKGROUND OF THE INVENTION

1. Field of the Invention

The present invention relates to the crushing and grinding of materials. More specifically, this invention is directed to ferrous alloys suitable for use in crushing and grinding devices, such as balls and rods, and for use in attrition members, such as the lining plates of crushing and grinding mills, crushing jaws and the like, which are subjected to abrasion and repeated shocks. Accordingly, the general objects of the present invention are to provide novel and improved methods and materials of such character.

2. Description of the Prior Art

While not limited thereto in their utility, alloys prepared in accordance with the present invention are particularly well suited for use in the crushing or grinding of materials in a moist medium, including liquid moist mediums comprising hot and corrosive gases, and also in processes and apparatus which simultaneously crush and dry materials. In the industries concerned with wet grinding and crushing techniques attempts have been made to use special types of cast iron and steels as grinding elements or in crushing devices; the excellent wear resistance properties of these materials having been proven in dry grinding operations. For example, cast iron containing 4% nickel and 1.5% chromium in the as-cast condition, with or without tempering, has been proposed for use in dry grinding. Similarly, it has been proposed to use hardened 12% chromium cast iron, cast iron containing 15% chromium and 3% molybdenum in the as-cast or hardened condition, cast iron containing 26% chromium in the as-cast or hardened condition and 12% manganese austenitic steels for dry grinding. These prior art alloys have not proved economical for a number of reasons and, accordingly, at present the practice in the art is to employ the least expensive available materials for crushing and grinding operations. Such inexpensive materials include ordinary steel, low chromium alloyed perlitic white iron and, on occasion, ore, blocks of silica, or pebbles or bolders from a local river or sea shore have been used. In short, it is presently considered preferable to re-equip grinding mills regularly with these inexpensive materials or devices formed thereof in view of the lack of availability of materials having high resistance to wear which are competitively priced.

It is known that when grinding in a moist medium wear depends primarily on two factors; these factors being abrasion and corrosion. In order to resist abrasion, steels or cast iron having a high content of carbon and carbides, preferably in a hardened condition, must be used. In order to resist corrosion, it is necessary to employ, in the surfaces which will actually accomplish the grinding, alloys having a high chromium content. Although the necessity of providing abrasion and corrosion resistance and the materials which offer these characteristics are well known, alloys with a high carbon and a high chromium content have not previously been employed in grinding apparatus because it has not previously been possible to combine a suitable choice of composition of alloy with a suitable heat treatment procedure in such a manner as to economically obtain materials having the desired abrasion and corrosion resistance characteristics.

SUMMARY OF THE INVENTION

The present invention overcomes the above briefly discussed and other deficiencies and disadvantages of the prior art by providing novel alloys suitable for use in crushing and grinding devices and apparatus. The alloys in accordance with the present invention are treated so as to have excellent wear resistance properties even when exposed to repeated impacts in the presence of abrasive materials being crushed in a liquid or moist medium which may contain hot and/or corrosive/drying gases.

The present invention, accordingly, provides ferrous alloys including primary chromium carbides and possibly secondary chromium carbides. these ferrous alloys comprise a solid solution containing 0.30–0.45% carbon and 14–18% chromium; said solid solution being substantially martensitic, without ferrite, and obtained by hardening at a temperature between 1075° C and 1175° C. The solid solution and the secondary chromium carbides make up the matrix. The alloys in accordance with the present invention have total contents of carbon and chromium determined by the following interrelation:

$$11 \leqq \%\ Cr - 8\ (\%\ C) \leqq 16 \qquad (1)$$

That is, in accordance with this invention the total percent by weight of chromium less 8 times the total percent by weight of carbon in the alloys must be within the range of 11–16.

Thus, in accordance with the present invention, alloys having a high chromium content are heat treated so as to obtain special properties enabling these cast metals to effectively resist wear in a moist medium. The four principle crieria which define the metallographic structure of the novel alloys of the present invention are:

1. a content of 0.30% to 0.45% carbon in solid solution according to the equilibrium diagram of iron, carbon and chromium,
2. a content of 14–18% chromium in solid solution according to the same diagram,
3. the matrix must be substantially formed of martensite in solid solution and be free of ferrite, and
4. and alloys must have total contents of carbon and chromium bound by the relationship $$11 \leqq \%\ Cr - 8\ (\%\ C) \leqq 16$$

BRIEF DESCRIPTION OF THE DRAWING:

The present invention may be better understood and its numerous features and advantages will become obvious to those skilled in the art by reference to the following description in junction with the drawing wherein:

FIG. 1 shows the limits of compositions of preferred alloys responding to the conditions of the invention;

FIG. 2 shows variations in the wear on the balls of grinding mills for a cast iron containing primary carbides and a matrix containing 0.4% of carbon in a martensitic solid solution state as a function of the content of chromium in the martensitic solid solution;

FIG. 3 is a section at the value of 2% carbon in the diagram of Bungardt, Kunze and Horn in which a preferred alloy according to the invention is particularly indicated; and FIG. 4 shows the range of molybdenum content used as an additional element in alloys in accordance with the present invention.

DESCRIPTION OF THE PREFERRED EMBODIMENTS

The ranges of carbon and chromium content of alloys in accordance with the present invention is indicated on FIG. 1. The contents by weight of these two materials in the alloys must be contained within the quadrilateral A, B, C, D; the coordinates of which are A equals 0.5%C and 20%Cr, B equals 2.4%C and 35%Cr; C equals 2.8%C and 33%Cr; and D equals 0.5%C and 15%Cr. As will be obvious to those skilled in the art, alloys in accordance with the present invention will additionally comprise the other elements which are normally present in slight quantities in these types of alloys, such as manganese and silicon, or which constitute impurities such as sulphur, phosphorus and the like.

A first embodiment of the present invention comprises a composition defined by the quadrilateral CDEF selected from within the quadrilateral ABCD. The composition defined by quadrilateral CDEF is subjected to blast or calm air at a temperature between 1075° C and 1150° C. If, for example, an alloy is selected having 2%C, 29%Cr, 0.4%Si, 0.4%Mn, 0.06%S and 0.06%P, it will after hardening exhibit a hardness between 60 and 64Rc and a metallographic structure formed of primary carbides and a matrix including secondary chromium carbides and a solid solution which fulfills criteria 1–4 above. Moreover, the ratio set forth in equation (1 ) will also be fulfilled.

The properties of an alloy in accordance with the first embodiment of the invention may be improved by completing the hardening with a cold treatment at a temperature which may be as low as −180° C so as to transform a part of the residual austenite into martensite and in this manner to achieve greater hardness and indeformibility of the structure when exposed to the action of repeated impacts. In alloys which have been subjected to a cold treatment the oxides which are inevitably formed on the surface of articles fabricated from the alloys are less quickly removed by the effect of blows, thus giving the articles improved resistance to wear.

In a wear test in a ball-type grinding mill, the wear-resistance of the above described first embodiment of an alloy in accordance with the invention was found to be approximately twice that of a prior art alloy having 26% chromium and 2.7% carbon. It may be noted that alloys having 30% chromium are well known per se but such prior art alloys are not produced in accordance with nor do they fulfill the above listed four criteria. Thus, the prior art alloys are generally of two types; these types either being cast irons having a ferritic structure or cast irons having a martensitic or austenitic structure, or both structures. The cast irons having the ferritic structures have been selected for their resistance to corrosion or oxidation under heat up to 1050° C. Cast irons of the ferritic structure type are typically comprised as follows:

1. 1 -1.5%C, 30%Cr, 0.5%Si, 0.5%Mn and 0–0.2-%Al; or
2. 2%C, 30%Cr, 2.25%Si and 0.6%Mn.

These prior art cast irons have 0.01–0.05%C and 12.5–17.5%Cr in solid solution. As noted, this solid solution is ferritic and the total hardness of these prior art cast irons is in the range of 22–30 Rc.

Prior art cast irons of the second type, that is those having either a martensitic structure, an austenitic structure or those comprised simultaneously of large quantities of austenite and martensite have, by way of example, the following composition:

1. 2.7–3%C, 27–30%Cr, 0.5%Si and 0.5%Mn.

The second type cast iron alloys have in solid solution either 0.7–0.9%C and 16–18%Cr when they have the austenitic structure, or 0.4–0.5%C and 12–13%Cr when they have the martensitic structure.

In the above analysis of prior art cast irons it will be noted that neither of the two types of alloys simultaneously satisfies the four above listed criteria.

In FIG. 2 the variation in the wear on grinding mill balls is shown for a cast iron having primary chromium carbides and a solid solution containing 0.4% C in the martensitic state, as a function of the content of chromium in solid solution. It will be noted that wear is minimal for a chromium content between 14–18% and that it diminishes in passing from 14 to 18%. Over 18% chromium ferrite begins to appear in the structure with a substantial increase in wear. Wear is maximal for a completely ferritic structure. If the chromium content is further increased, wear again slightly diminishes since chromium hardens ferrite.

In accordance with a second embodiment of the present invention, a composition limited by the quadrilateral ABGH, lying within the quadrilateral ABCD, is selected and is hardened in blast air or calm air at a temperature between 1075%C and 1175%. Thus, for example, an alloy may be chosen having the following compsition:

2%C, 31.25%Cr, 0.4%Si, 0.4%Mn, 0.6%P and 0.06%S.

The alloy in accordance withe the above example of the second embodiment of the present invention is indicated by a dotted line on the diagram shown in FIG. 3. FIG. 3 is a section, at the value of 2%C, in the diagram of Gungardt, Kunze and Horn. In such an alloy, the first phase which solidifies is the ferrite. A structure is thus obtained containing primary chromium carbide and a matrix containing no secondary carbides. Accordingly, galvanic couples are avoided between the secondary carbides and the solid solution during use these alloys in an aqueous medium. During the subsequent hardening process, no secondary carbides appear. In the hardened codition the structure is substantially martensitic and free of ferrite. The total hardness of this alloy is 62-64 Rc.

As in the case of the above-described first embodiment, hardening of the second embodiment of the invention may preferably be terminated by a cold treatment at a temperature which may be as low as −180° C. The cold treatment converts a part of the residual austenite into martensite.

During a test in a ball-type grinding mill, the example alloy in accordance with the second embodiment of the invention showed wear approximately 2.5 times less than a cast iron containing 26%Cr and 2.7%C.

It is to be noted that alloys defined by the quadrilateral EFGH may or may not include secondary carbides depending on the amount of Mn, Si, S and P, which are always present, and also depending upon whether materials such as Ni, Cu, No, W, V, Ti, happen to be present In accordance with a third embodiment of the present invention, some of the chromium in solid solution is replaced by molybdenum according to the following relationship:

$$\% \text{ Cr in the matrix} = \% \text{ Mo} + 14\text{–}18 \quad (2)$$

Since the percentage of chromium in solid solution must be euql to or greater than 14% in accordance with the above-stated criteria (2 ), the percentage of molybdenum is between 0 and 4%. the remaining 3 of the above listed criteria must, of course, also be respected.

FIG. 4 shows within the quadrilateral ABCD, four zones I–IV. The percentage by weight of molybdenum defined by each of these four quadriangles or zones is indicated; the amount of molybden conforming to the preceding criteria.

A first example in accordance with the third embodiment of the present invention comprises a composition falling within the confines of quadrilateral MCDN (zone I) which is subjected to hardening in blast or calm air at a temperature in the range of 1075° C to 1125° C. If, for example, an alloy is selected having 2%C, 27%Cr, 3%Mo, 0.4%Si, 0.4%Mn, 0.06%P and 0.06%S, after hardening it will have in solid solution approximately 0.40%C, 14%Cr and 3%Mo. It is presumed that the molybdenum is distributed uniformly between the carbides and the solid solution. The alloy thus is composed of primary and secondary chromium carbides and substantially a martensitic solid solution which is free of ferrite. The total hardness of the example cast iron being discussed, after hardening, is 63–67 Rc.

A second example in accordance with the third embodiment of the invention comprises an alloy defined by the quadrilateral KMNL (zone II) which is hardened at a temperature between 1075° and 1140° C. Such an example may have 2%C, 28.6%Cr, 2%Mo, 0.4%Si, 0.4%Mn, 0.06%P and 0.06%S. After hardening the alloy in this example will have in solid solution approximately 0.38%C, 15.2%Cr and 2%Mo presuming the molybdenum is uniformly distributed between the carbides and the solid solution. The alloy will be comprised of primary and secondary chromium carbides and a substantially martensitic solid solution free of ferrite. The matrix is made up of the solid solution and the secondary carbides. The total hardness of such a cast iron after hardening is 62–66 Rc.

A third example in accordance with the third embodiment of the invention may be an alloy defined by the quadrilateral IKLJ (zone III) which has been subjected to hardening at a temperature between 1075° and 1155° C. Such an alloy may, for example, have 2%C, 29.8%Cr, 1.25%Mo, 0.4%Si, 0.4%Mn, 0.06%P and 0.06%S. After hardening, this alloy will have in solid solution approximately 0.35%C, 16.2%Cr and 1.25%Mo presuming again that the molybdenum is uniformly distributed between the carbides and the solid solution. The alloy of this third example is composed of primary carbides and possibly of secondary chromium carbides, and a solid martensitic solution free of ferrite. The matrix is made up of the solid solution and the secondary carbides. The total hardness of such a cast iron lies in the range of 61–65Rc.

It is to be noted that alloys defined by the quadrilateral IKLJ may or may not have secondary carbides according to the amount of Mn, Si, S and P present and also depending upon whether any Ni, Cu, W, V, Ti happen to be present.

A fourth example in accordance with the third embodiment of the present invention may be an alloy defined by the quadrilateral BIJA (zone IV) which has been subjected to hardening at a temperature in the range of 1075° to 1175° C. Such an allow may, for example, include 2%C, 31.2%Cr, 0.75%Mo, 0.4%Si, 0.4%Mn, 0.06%P and 0.06%S. After hardening, this example alloy will have, in solid solution, approximately 0.32%C, 17%Cr and 0.75%Mo presuming that the molybdenum is distributed uniformly between the carbides and the solid solution. The structure of the alloy is composed of primary chromium carbides without secondary carbides and a martensitic solid solution free of ferrite (matrix). The total hardness of such a cast iron lies between 60 and 64Rc.

As in the case of the first and second embodiments of the invention, the four examples of the third embodiment as reported above may provide better results when used in grinding devices of cold treated after hardening at temperatures which may be as low as −180° C.

In accordance with common practice, the percentages expressed in the preceding description are by weight. Also, in accordance with common practice, the term "cast metal" has sometimes previously been employed to designate alloys having a high content of chromium. It is, however, to be noted that the present invention has been described by way of illustration and not limitation and various modifications and substitutions may be made thereto without departing from the spirit and scope thereof. Accordingly, the present invention should not be deemed to be limited to a particular alloy or composition.

What is claimed is:

1. Heat-treated cast grinding members for use in a grinding mill wherein said members are subjected to abrasion and repeated impacts in the presence of a wet corrosive medium, said members essentially of 0.5% to 2.8% carbon, 15.0% to 35.0% chromium the balance being essentially iron except for manganese and silicon, the optional addition of which is known in the production of wear-resistant castings and normal impurities; wherein the total percentage by weight of carbon and chromium must satisfy the relationship $$\%\text{Cr} - 8 \times \%\text{C} = 11 \text{ to } 16\%;$$

said heat-treated members having been subjected to processing including hardening without subsequent tempering from a temperature range of from 1075° to 1175° C in such a manner as to evidence a metallographic structure of primary chromium carbides in a ferrite-free matrix which is a predominantly martensitic solid solution consisting essentially of from 0.30% to 0.45% of carbon and from 14% to 18% of chromium, and said members having a Rockwell "C" hardness of at least 60.

2. Heat-treated cast grinding members for use in a grinding mill wherein said members are subjected to abrasion and repeated impacts in the presence of a wet corrosive medium, said members consisting essentially of 0.5% to 2.8% carbon, 15.0% to 35.0% chromium, and up to 4.0% molybdenum, the balance being essentially iron except for manganese and silicon the optional addition of which is known in the production of wear-resistant castings and normal impurities; in which members the total content in percentage by weight of carbon and chromium must satisfy the relationship $$\%Cr - 8 \times \%C = 11 \text{ to } 16\%,$$

said heat-treated members having been hardened without subsequent tempering from a temperature range of from 1075° to 1175° C in such a manner as to evidence a metallographic structure of primary chromium carbides in a ferrite-free matrix which is a substantially martensitic solid solution consisting essentially of from 0.30% to 0.45% of carbon, the chromium and molybdenum being determined by the relationship %Cr (in the solid solution) + %Mo (total) = 14 to 18%, and said members having a Rockwell "C" hardness of at least 60.

3. The members of claim 1 wherein the total amounts in percentage by weight of chromium and carbon are limited to percentages encompassed within a quadrilateral of a chromium-carbon coordinate diagram being defined as follows:

C = 0.5%; Cr = 20%;
C = 2.4%; Cr = 35%;
C = 2.8%; Cr = 33%;
C = 0.5%; Cr = 15%.

4. The members of claim 1 wherein the total amounts in percentage by weight of chromium and carbon in the members are limited to percentages encompassed within a qualilateral of a chromium-carbon coordinate diagram defined as follows:

C = 0.5%; Cr = 19%;
C = 2.5%; Cr = 34.6%;
C = 2.8%; Cr = 33%;
C = 0.5%; Cr = 15%, and wherein said metallographic structure comprises both primary and secondary chromium carbides and the hardening heat treatment was from a temperature of the range of 1075° to 1150° C.

5. The members of claim 4 consisting essentially of the following elements in weight %:

C = 2.0%
Cr = 29.0%
Si = 0.4%
Mn = 0.4%
S = 0.06%
P = 0.06% and the balance being essentially iron.

6. The members of claim 1 wherein the total amounts in percentage by weight of chromium and carbon are limited to percentages encompassed within a quadrilateral of a chromium-carbon coordinate diagram, said quadrilateral being defined as follows:

C = 0.5%; Cr = 20%
C = 2.4%; Cr = 35%
C = 2.56%; Cr = 34.2%
C = 0.5%; Cr = 18% said alloys containing only primary chromium carbides.

7. The members of claim 6 consisting essentially of the following elements in weight %:

C = 2.0%
Cr = 31.25%
Si = 0.4%
Mn = 0.4%
P = 0.06%
S = 0.06% the balance being essentially iron.

8. The members of claim 2 wherein the total amounts in percentages by weight of chromium and carbon are limited to percentages encompassed within a quadrilateral of a chromium-carbon coordinate diagram, said quadrilateral being defined as follows:

C = 0.5%; Cr = 20%;
C = 2.4%; Cr = 35%
C = 2.8%; Cr = 33%;
C = 0.5%; Cr = 15%.

9. The members of claim 2 wherein the total amounts in percentages by weight of chromium and carbon are limited to percentages encompassed within a quadrilateral of a chromium-carbon coordinate diagram, said quadrilateral bein defined as follows:

C = 0.5%; Cr = 16.25%;
C = 2.7%; Cr = 33.5%;
C = 2.8%; Cr = 33%;
C = 0.5%; Cr = 15%;

wherein said temperature range is between 1075° to 1125° C and said metallographic structure contains both primary and secondary chromium carbides.

10. The members of claim 9 consisting essentially of the following elements in weight %:

C = 2.0%
Cr = 27.5%
Mo = 3.0%
Si = 0.4%
Mn = 0.4%
S = 0.06%
P = 0.06% the balance being essentially iron.

11. The members of claim 2 wherein the total amounts in percentage by weight of chromium and carbon are limited to percentages encompassed within a quadrilateral of a chromium-carbon coordinate diagram, said quadrilateral being defined as follows:

C = 0.5%; Cr = 17.5%;
C = 2.6%; Cr = 34.0%;
C = 2.7%; Cr = 33.5%
C = 0.5%; Cr = 16.25% the total amount of molybdenum in said members not exceeding 3%, wherein said temperature range is between 1075° and 1140° C and said metallographic structure contains both primary and secondary chromium carbides.

12. The members of claim 11 consisting essentially of the following elements in weight %:

C = 2.0%
Cr = 28.6%
Mo = 2.0%
Si = 0.4%
Mn = 0.4%
S = 0.06%
P = 0.06% the balance being essentially iron.

13. The members of claim 2 wherein the total amounts in percentage by weight of chromium and carbon are limited to percentages encompassed within a quadrilateral of a chromium-carbon coordinate diagram, said quadrilateral being defined as follows:

C = 0.5%; Cr = 18.75%;
C = 2.5%; Cr = 34.5%;
C = 2.6%; Cr = 34.0%;
C = 0.5%; Cr = 17.5%;

the total amount of molybdenum not exceeding 2% wherein said temperature range is between 1075° to 1115° C.

14. The members of claim 13 consisting essentially of the following elements in weight %:

C = 2.0%
Cr = 29.8%
Mo = 1.25%
Si = 0.4%
Mn = 0.4%
S = 0.06%
P = 0.06% the balance being essentially iron.

15. The members of claim 2 wherein the total amounts in percentage by weight of chromium and carbon are limited to percentages encompassed within a quadrilateral of a chromium-carbon coordinate diagram, said quadilateral being defined as follows:

C = 0.5%; Cr = 20%;
C = 2.4%; Cr = 35%;
C = 2.5%; Cr = 34.5%;
C = 0.5%; Cr = 18.75%;

the total amount of molybdenum not exceeding 1% and the members containing only primary chromium carbides.

16. The members of claim 15 consisting essentially of the following elements in weight %:

C = 2.0%
Cr = 31.2%
Mo = 0.75%
Si = 0.4%
Mn = 0.04%
S = 0.06%
P = 0.06% the balance being essentially iron.

17. The members of claim 1 wherein the hardened members are further subjected to a cold treatment at a temperature down to −180° C to transform part of the residual austenite into martensite.

18. The members of claim 2 wherein the hardened members are further subjected to a cold-treatment at a temperature down to −180° C to transform part of the residual austenite into martensite.

19. The members of claim 1 wherein said members are balls, crushing jaws and lining plates for grinding mills.

20. The members of claim 2 wherein said members are balls, crushing jaws and lining plates for grinding mills.

* * * * *